United States Patent [19]

Colombo

[11] Patent Number: 4,669,527

[45] Date of Patent: Jun. 2, 1987

[54] COOLED ROLLER FOR THE CONTINUOUS CASTING OF FLAT BARS

[76] Inventor: Enzo Colombo, Via Latisana 20, I-33100 Udine, Italy

[21] Appl. No.: 716,946

[22] Filed: Mar. 28, 1985

[30] Foreign Application Priority Data

Apr. 6, 1984 [IT] Italy ..... 12483 A/84

[51] Int. Cl.[4] ..... B22D 11/06

[52] U.S. Cl. ..... 164/428; 164/443; 165/89

[58] Field of Search ..... 164/428, 480, 423, 427, 164/429, 443, 463, 479, 485; 165/89, 90

[56] References Cited

U.S. PATENT DOCUMENTS

| | | | |
|---|---|---|---|
| 2,433,121 | 12/1947 | Hornbostel | 165/89 X |
| 2,693,012 | 11/1954 | Harris et al. | 164/428 X |
| 3,006,610 | 10/1961 | Siegel | 165/89 |
| 3,144,905 | 8/1964 | Albert | 165/89 |

FOREIGN PATENT DOCUMENTS

| | | | |
|---|---|---|---|
| 58-168462 | 10/1983 | Japan | 164/428 |
| 890360 | 2/1962 | United Kingdom | 164/429 |

*Primary Examiner*—Nicholas P. Godici
*Assistant Examiner*—J. Reed Batten, Jr.
*Attorney, Agent, or Firm*—Larson and Taylor

[57] ABSTRACT

A roller (R) for the continuous casting of metallic flat bars or plates (S), having a high solidification factor, a satisfactory life of the cylindrical cooling mantle (4) and ease of substituting same. The mantle (4) is formed by a thin metallic, normally copper cylinder, cooled by water flowing at high speed through conduits (41) formed beneath the internal surface of the mantle, a valve structure (12–11) being provided for feeding each conduit independently from the others. The mantle (4) is sustained by a central hub (1,2), and is kept firmly into shape by filling with a suitable material, as for instance a mixture of sand and cement (303), the annular chamber (3) between the mantle (4) and the central hub (1,2). The water cooling of the mantle may be only limited to the contact zone between liquid metal and mantle (4), or may be extended to the whole surface of the mantle.

10 Claims, 8 Drawing Figures

COOLED ROLLER FOR THE CONTINUOUS CASTING OF FLAT BARS

BACKGROUND OF THE INVENTION

This invention relates to continuous casting plants, and more particularly to a cooled roller for the continuous casting of flat bars or plate like metallic elements.

The known, prior art rollers used for the continuous casting of flat bars or plates, have proved themselves unsuitable for the intended use, due to the following reasons:

They have a low solidification factor, due mainly to the great thickness of the mantle in contact with the molten metal being cast, together with an insufficient cooling of the said mantle.

The average life of said rollers is comparably short, due to the quick aging and perishing of the metal of the mantle, due to the high frequency and amplitude of the thermal excursion to which the mantle is subjected.

It is therefore the main object of the present invention to provide a cooled roller for the continuous casting of flat bars or plates, in continuous casting plants, by means of which the drawbacks of the prior art rollers are overcome.

SUMMARY OF THE INVENTION

According to one feature of the invention, the above object is attained by providing, in a continuous casting plant for metals, a roller comprising:

a cylindrical mantle formed by a metallic cylinder comparatively thin with respect to its diameter, provided on its inner surface with longitudinal ducts for the circulation of a refrigerating fluid;

a central hub having an external diameter which is substantially smaller than the inner diameter of said cylindrical mantle, concentrically mounted with respect to said mantle, so as to leave an annular gap between them;

said annular gap being filled with a suitable bonding material connecting the said outer mantle to the said central hub.

BRIEF DESCRIPTION OF THE DRAWINGS

Further characteristic features and advantages of the invention will become apparent from the following description of some preferred embodiments of the invention, made with reference to the accompanying drawings, in which.

DESCRIPTION OF THE PREFERRED EMBODIMENTS

Figure 1:
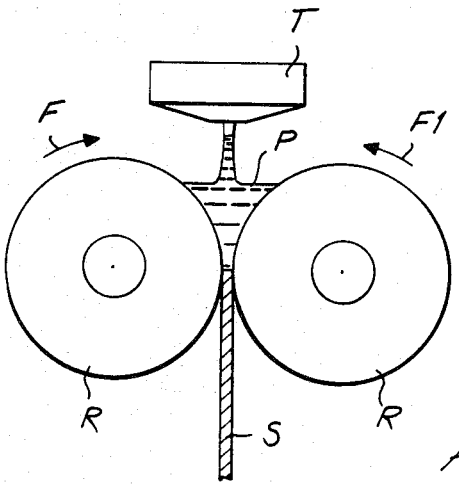
FIG. 1 is a diagrammatic side view showing a continuous casting plant for flat bars, provided with casting rollers of the kind used in the invention.

With reference to FIG. 1 of the drawings, a continuous casting plant for casting metal flat bars or sheet like elements S is shown. In a manner per se known, the said plant comprises two counter-rotating rollers R, rotating respectively in the directions of the arrows F and F1, defining between their upper portions a pit P in which the molten metal from the tundish T is poured, and from which the said molten metal is cast into a continuous flat bar or sheet S by the action of the said rollers R.

Figure 2:
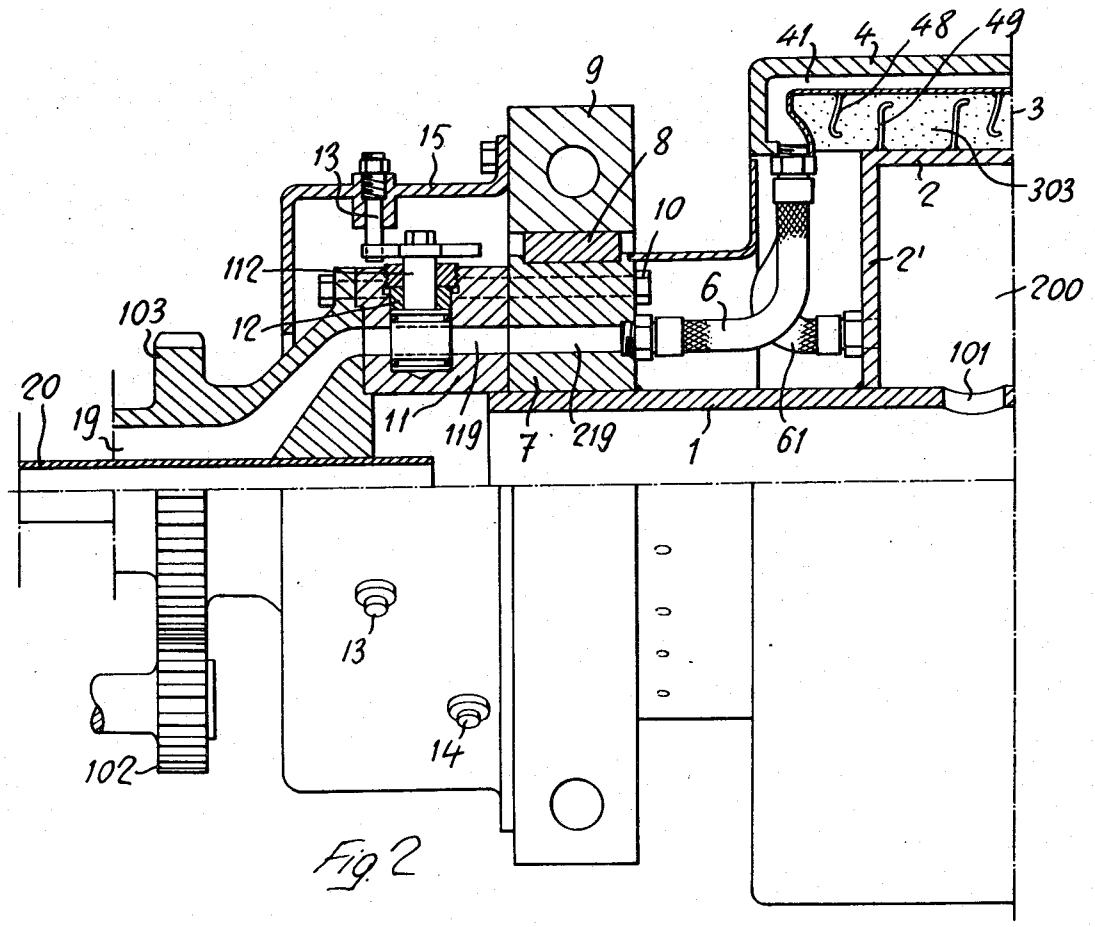
FIG. 2 is a side view, partially sectioned, of one end of a roller according to the invention.

With particular reference to FIG. 2 of the drawings, one of the rollers R according to the invention will be now described.

The said roller comprises, as shown, has a central hub formed by an inner tubular member 1 and a second tubular member 2 concentrically disposed around the member 1, the said tubular member 2 being sealed at its ends by the annular plates 2'. Concentrically on the tubular member 2, the cylindrical outer mantle 4 of the roller is disposed, leaving between the inner surface of mantle 4 and the outer surface of the tubular member 2 an annular chamber 3. The inner surface of the mantle 4 is formed with a plurality of channels 41 for the flow of a refrigerating fluid, normally water. Each channel 41 is connected through a flexible pipe 6 to a flange member 7 welded to the member 1. A second flange member 11 is secured by means of bolts 10, to the flange 7. In the flange 11 a plurality of cocks 12 are seated, each controlling the flow of refrigerating fluid from the inlet 19 through the passages 119 and 219 in the flanges 11 and 7, to the feeding pipes 6 and from said pipes to the refrigerating channels 41. The refrigerating water is fed to the inlet 19 from a suitable source, through an (undisclosed) rotating joint. The water flowing in the channels 41 is thereafter discharged through pipes 61, communicating with the interior of the tubular member 2, and therefrom through radial holes 101 formed in the member 1, into the interior of member 1, and therefrom through discharging pipe 20 to the exterior.

The roller R is driven through the pinion 102 in mesh with the toothed crown 103 connected to the member 1. The roller R is supported for rotation on two end supports 9, secured to the frame (not shown) of the casting plant, with the interposition between said supports 9 and the flange 7 of an antifriction ring 8.

To the upper end of each spindle 112 of each rotating male element of the cocks 12, a cross bar 121,122 is secured, formed at its ends with a cam like profile. The said cross bars 121,122 cooperate with the actuating pins 13,14, fastened to the case 15 secured to the support 9, and extending radially inwardly into the path of the said cross bars 121,122, so as to automatically open or close the cocks 12 during rotation of the roller R. In this manner it is possible to cool only that portion of the mantle 4 which is in contact with the molten metal, leaving the remaining of the mantle 4 at its average temperature.

As a result of the above feature, the thermal excursion of the mantle 4 is substantially reduced, thus reducing the thermal stress to which it is subjected.

The chamber 3, between the channels 41 and the tubular member 2, is filled with a suitable cement 303, as it will be described in further detail below. The channel 41 may be formed in many ways. Some preferred embodiments of said channels are shown in FIGS. 6 to 8, and will be described particularly below.

Figure 6:
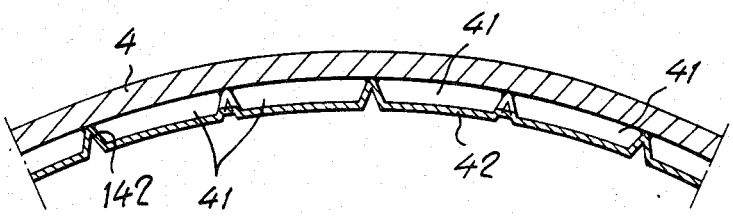
FIG. 6 shows, in enlarged scale, and in cross section, one portion of the mantle of the roller of FIG. 2.

With particular reference to FIG. 6, the said channels 41 are formed by securing to the inner surface of the mantle 4, for instance by means of welding, glueing or riveting, a sheet 42 provided with parallel ribs, or corrugations 142.

Figure 8:
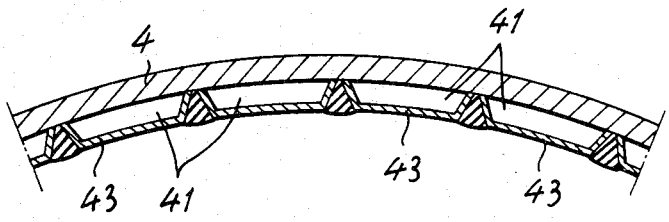

According to the embodiment shown in FIG. 8, the said channels 41 are formed by securing to the inner surface of the mantle 4, for instance by welding, glueing or riveting, a number of sidewise extending parallel channel-like substantially U-shaped members 43.

Figure 7:
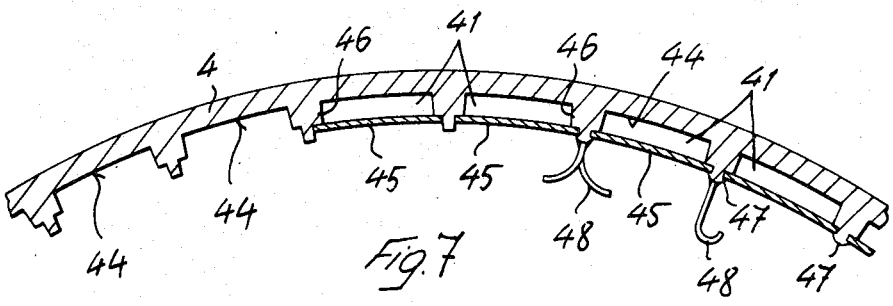
FIGS. 7 and 8 are two views similar to the view of FIG. 6, of two other embodiments of the mantle according to the invention.

According to a still further embodiment, shown in FIG. 7, the channels 41 are formed by engraving a number of grooves 44 into the inner surface of the mantle 4, and by closing said grooves by means of thin strips 45 extending between the parallel ribs 46 separating the single contiguous grooves from one another. The said strips may again be secured to said grooves by welding, glueing or riveting. Advantageously, however, they are secured by riveting the free ends of said ribs 46, as shown at 47.

The embodiment described with reference to FIG. 7, although more expensive, has with respect to the embodiments shown in FIGS. 6 and 8, the following advantages:

Possibility of forming conduits 41 which are absolutely identical to one another, thus assuring a greater uniformity of cooling to the mantle 4.

For mantles 4 having equal thickness, a greater resistance to the deformation is conferred to the mantle, particularly in case or rollers of great length, thanks to the presence of the longitudinal ribs defining the said grooves.

The above construction may be performed also with mantles 4 having a relatively small internal diameter, which would not permit the introduction inside of said mantle of a welder, but which is sufficient for the introduction of a riveting tool.

The strips 45 may be easily removed from the grooves, whenever said strips are made of a material different from the material of the mantle 4, so as to recover the metallic mass of said mantle without impurities due to a welding process.

The strips 45 or the channel like elements 42 or 43 may be made of metal or of plastics.

As filling material 303 for the chamber 3 any suitable cement or bonding material may be used, which is apt to firmly bond the mantle 4 to the tubular member 2, or to the member 1.

Suitable materials which may be used to this end are for instance semi-liquid mortars and similar materials, especially quick setting cement and/or gypsum mortars; self-hardening resins, or plastic materials which may be also mixed with sand, saw dust or other filling materials; adhesive pastes or the like, mixed or not with inert fillers.

In order to increase the bond between the tubular member 2 and the mantle 4, anchoring elements 48,49 may be provided, as shown in FIGS. 2 and 7, secured both to the mantle 4 and to the tubular member 2, to be let into the filling material 303. The filling mass 303 has the purpose of transmitting the driving torque from the central pivot (through the tubular element 2) to the mantle 4, as well as to preserve the cylindrical shape of the mantle 4, and to sustain the thin walls of the channels 41.

Although in the embodiment shown in FIG. 2, the intermediate tubular member 2 is shown between the member 1 and the mantle 4, the said member 2 may be omitted, and the chamber 200 defined by the said element may be filled with the filling material 303.

From the above, it will be evident that the roller according to the invention has many advantages with respect to the prior art rollers. Among the said advantages, the following may be cited:

better able to withstand the thermal stress;
the danger of deformation of the mantle 4 is reduced;
better cooling of the mantle;
possibility of a quick change of the whole roller;
long life.

Further advantages of the rollers according to the invention are related to the efficiency and the uniformity of its cooling.

Figure 3:
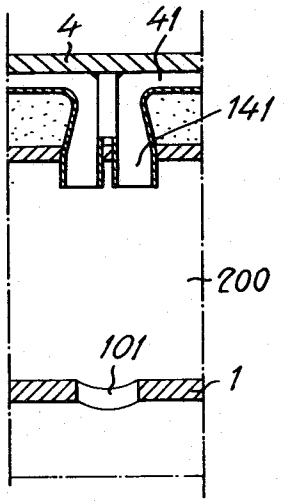
FIG. 3 is a partial view showing one embodiment of the refrigerating fluid discharging arrangement for a roller according to the invention.
Figure 4:
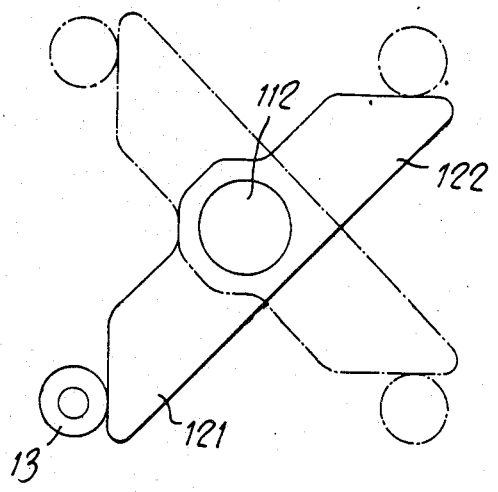
FIGS. 4 and 5 show an embodiment of the device for switching the refrigerating fluid flow to the mantle.
Figure 5:
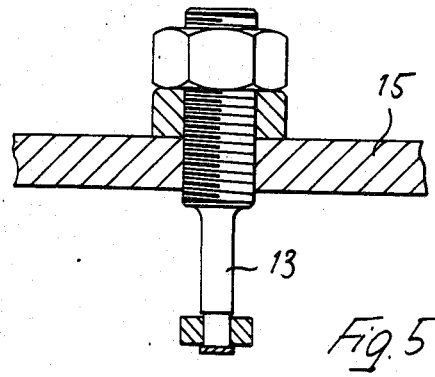

Rollers provided with a long mantle may present a difference in temperature of from 5° to 15° C. between the cooling fluid inlet and outlet ends of the channels 41. Whenever this occurs, it may be advisable to feed the channels 41 alternately from one side and from the opposite one of the roller R. In this instance, the exhaust pipes 61 are connected to the chamber 200, as shown in FIG. 2. Should the rollers be very long, and for instance should their length be in the order of 2 meters, the channels 41 are suitably fed from both ends, with their outlets 141 communicating with the central portion of the chamber 200, as shown in FIG. 3.

In this manner, the length of the channel 41 is reduced to one half of the length of the mantle 4, thus reducing also the thermal difference along the channel.

Of course, the present invention is not limited to the embodiments shown and described, and it may undergo several changes without departing from the spirit of the invention, substantially as claimed in the following claims.

I claim:

1. In a continuous casting plant for casting metallic flat elements, said plant being of the kind comprising a pair of rotatably supported counter rotating rollers having parallel facing outer cylindrical mantles which define between them a gap through which molten metal passes as it is formed into the flat elements, an improved counter roller construction wherein:

each said outer cylindrical mantle has a thickness which is substantially smaller than its outer diameter, each roller further comprises a plurality of longitudinal refrigerating conduits extending parallel to each other in an axial direction along an inner surface of said mantle, for the circulation of a cooling fluid therethrough, and each roller further comprises a central axially extending hub supporting said mantle and having an external diameter smaller than the diameter of the inner surface of the mantle, to leave an annular space between the hub and the inner surface of the mantle for said conduits and including a bonding material in said space connecting the hub to the inner surface of the mantle.

2. The invention according to claim 1, in which the said refrigerating conduits are formed by applying against the inner surface of the said mantle a sheet-like element provided with corrugations, or with parallel ribs or grooves.

3. The invention according to claim 1, in which the said refrigerating conduits are formed by sidewise applying against the inner surface of said mantle U-shaped channel like elements.

4. The invention according to claim 1, in which the said refrigerating conduits are provided at one end with a refrigerating fluid inlet, and at the other end with a refrigerating fluid outlet, the said refrigerating fluid inlets being associated to at least one distributing element feeding the refrigerating fluid to those conduits disposed in correspondence of that portion of the mantle which is in contact with the molten metal being cast, while the said outlets are connected to at least one exhaust manifold.

5. The invention according to claim 1, further provided with anchoring means operatively secured both to the refrigerating conduits and to the central hub, which anchoring means are embedded into the bonding material in the space between the central hub and the inner surface of the mantle.

6. The invention according to claim 1, in which the hub comprises an outer member fixed to and concentrically mounted on a smaller inner member, the space between the outer and inner members being closed at both ends and communicating with the interior of the inner member so as to act as a manifold chamber for exhausting cooling fluid.

7. The invention according to claim 1, in which the said refrigerating conduits are formed by providing the inner surface of the mantle with grooves separated by ribs, and by closing said grooves by means of strips.

8. The invention according to claim 7, in which said strips are secured to said grooves by riveting the ends of said ribs.

9. The invention according to claim 1, in which the said bonding material in the space between the central hub and the inner surface of the mantle is formed by a semi-liquid mortar, or a self-hardening resin, or an adhesive paste, the said bonding material being mixed with inert fillers.

10. The invention according to claim 9, in which the said bonding material is selected so as to have a thermal expansion coefficient greater than the corresponding coefficient of the mantle.

* * * * *